US009797186B2

(12) United States Patent
Kronenberg et al.

(10) Patent No.: US 9,797,186 B2
(45) Date of Patent: Oct. 24, 2017

(54) PLUG CONNECTOR

(71) Applicants: Max Kronenberg, Solingen (DE); Ralf M. Kronenberg, Haan (DE)

(72) Inventors: Max Kronenberg, Solingen (DE); Ralf M. Kronenberg, Haan (DE)

( * ) Notice: Subject to any disclaimer, the term of this patent is extended or adjusted under 35 U.S.C. 154(b) by 152 days.

(21) Appl. No.: 14/435,265

(22) PCT Filed: Oct. 11, 2013

(86) PCT No.: PCT/EP2013/071279
§ 371 (c)(1),
(2) Date: Apr. 13, 2015

(87) PCT Pub. No.: WO2014/057089
PCT Pub. Date: Apr. 17, 2014

(65) Prior Publication Data

US 2015/0259969 A1 Sep. 17, 2015

(30) Foreign Application Priority Data

Oct. 12, 2012 (DE) ..... 20 2012 103 904

(51) Int. Cl.
*E06B 3/66* (2006.01)
*E06B 3/667* (2006.01)

(52) U.S. Cl.
CPC ..... *E06B 3/667* (2013.01); *Y10T 403/553* (2015.01)

(58) Field of Classification Search
CPC .... E06B 3/667; E06B 3/6675; E06B 3/67304; E06B 3/67308; Y10T 403/55; Y10T 403/553; Y10T 403/557; Y10T 403/559; F16B 7/0406; F16B 7/0413; E04B 9/10
See application file for complete search history.

(56) References Cited

U.S. PATENT DOCUMENTS 5,154,531 A * 10/1992 Peterson ..... E06B 3/667 403/205
5,560,731 A 10/1996 Kronenberg
6,764,247 B1 * 7/2004 Kronenberg ..... E06B 3/667 403/292

(Continued)

FOREIGN PATENT DOCUMENTS

CH 2730898 A1 * 1/2010 ..... E06B 3/667
DE 85 09 217 U1 6/1985

(Continued)

*Primary Examiner* — Jonathan Masinick
(74) *Attorney, Agent, or Firm* — McGlew and Tuttle, P.C.

(57) ABSTRACT

A straight connector (1), for hollow profiled elements (2) of spacer frames, mullions, or transoms for insulated glass panes, has several connector legs (6, 7) extending in various directions from a central connection point (9). The connector legs have retaining elements (18) for engaging on a hollow profiled element (2). The straight connector (1) has a base plate (10), with a top side with a raised support base (12) for the hollow profiled elements (2) and on both sides thereof on the connector legs (6, 7) the fin-like retaining elements (18) are arranged one after the other in a row. The support base (12) is arranged, in a longitudinal direction, in the center and has a center stop (8) for the hollow profiled elements to be put on, on both sides and which hollow profiled elements are supported at the joint (26) by the support base.

26 Claims, 5 Drawing Sheets

(56) References Cited

U.S. PATENT DOCUMENTS

| | | | | |
|---|---|---|---|---|
| 2004/0088943 | A1* | 5/2004 | Kronenberg | E06B 3/667 52/656.9 |
| 2007/0022700 | A1* | 2/2007 | Gallagher | E06B 3/667 52/656.9 |
| 2011/0203198 | A1 | 8/2011 | Kronenberg et al. | |

FOREIGN PATENT DOCUMENTS

| | | | | |
|---|---|---|---|---|
| DE | 299 21 229 | U1 | 3/2000 | |
| DE | 20 2005 004 601 | U1 | 2/2006 | |
| DE | 10 2005 045220 | A1 | 5/2006 | |
| DE | 102005007230 | A1 * | 9/2006 | E06B 3/667 |
| DE | 20 2004 021 566 | U1 | 3/2009 | |
| DE | 20 2008 013 046 | U1 | 2/2010 | |
| DE | 10 2009 003 869 | A1 | 11/2010 | |
| DE | 2397641 | A2 * | 12/2011 | E06B 3/667 |
| EP | 0 330 906 | A2 | 9/1989 | |
| EP | 0 698 172 | B1 | 3/1997 | |
| WO | 2008/035003 | A2 | 3/2008 | |
| WO | 2010/006745 | A1 | 1/2010 | |

* cited by examiner

Fig. 4
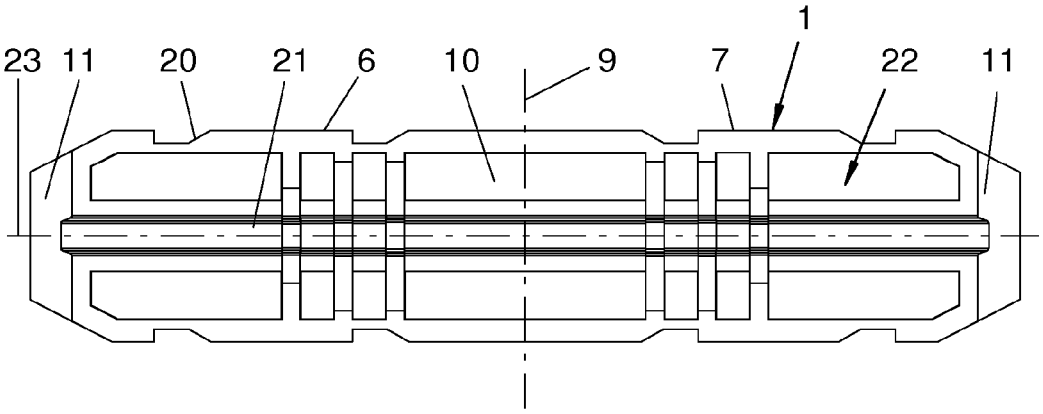
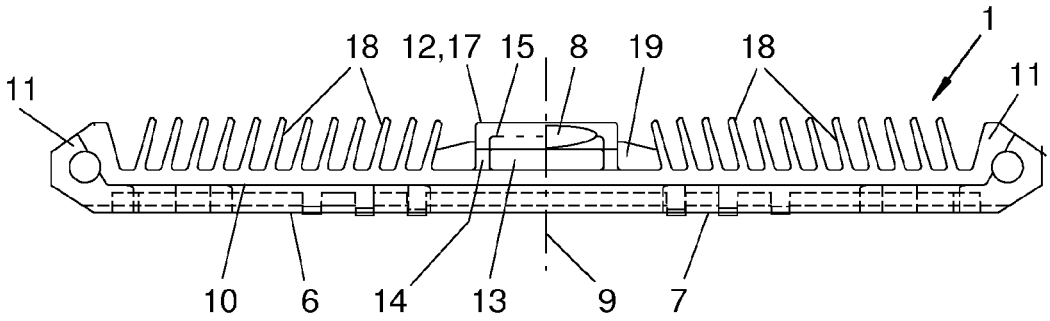
Fig. 5
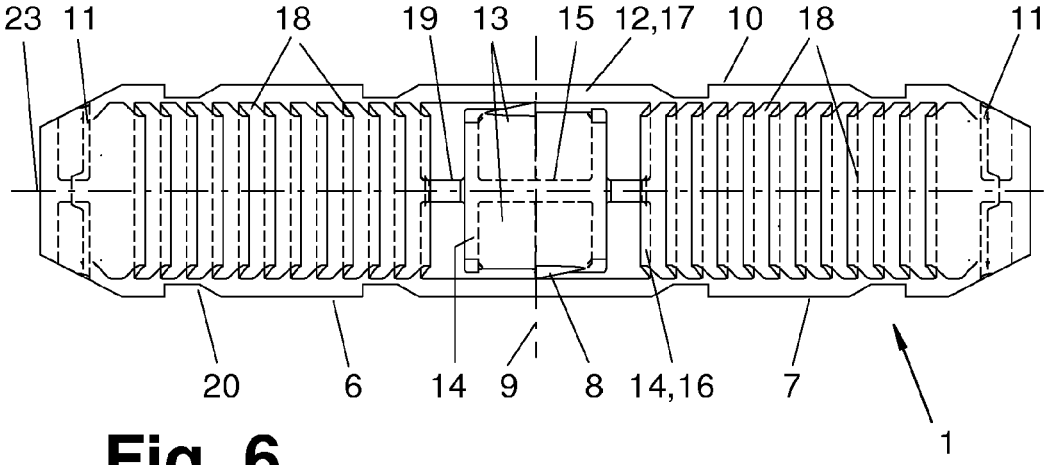
Fig. 6

PLUG CONNECTOR

CROSS REFERENCE TO RELATED APPLICATIONS

This application is a United States National Phase Application of International Application PCT/EP2013/071279 filed Oct. 11, 2013 and claims the benefit of priority under 35 U.S.C. §119 of German Application 20 2012 103 904.4 filed Oct. 12, 2012, the entire contents of which are incorporated herein by reference.

FIELD OF THE INVENTION

The present invention pertains to a plug connector for hollow profiled elements of spacer frames or bars for insulated glass panes, wherein the straight connector has a plurality of connector legs originating from a connection point in different directions with retaining elements for meshing with the hollow profiled element and a base plate and has a raised support base and, on both sides thereof, fin-like retaining elements are arranged in a row one after another at the connector legs on the top side of the base plate.

BACKGROUND OF THE INVENTION

A straight connector is known from WO 2008/035003 A1. It has a central massive collar, thickened on all sides, and connector legs adjoining same on both sides with a respective hollow support base as well as with a base plate each with a row of fins. The bilateral support bases and the respective hollow profiled elements plugged in there are spaced apart from the center of the connector by the broad collar, and the hollow profiled elements abut against a circumferential step between the collar and the support base on the end face. The support bases are narrower than the respective hollow profiled element and have laterally projecting anchor pins for digging into the side wall of the profiled element.

A plug connector having an omega-shaped cross section, which is used for warm-edge hollow profiled elements for spacer frames of insulated glass panes, is known from DE 20 2008 013 046 U1. The plug connector is designed for letting through a granulated desiccant in the hollow profiled element and has a lower central web and upright lateral webs, which adjoin same on the edge and which have an elastic cross-sectional shape bent in a step-like manner and carry sawtooth-like retaining elements at the free edge.

Another plastic plug connector with a U-shaped cross section, which has a perforated base plate and elastic lateral webs arranged thereon with ribs at the free edge of the web, is known from DE 10 2009 003 869 A1.

SUMMARY OF THE INVENTION

The object of the present invention is to provide a further improved plug connector.

According to the invention, a straight plug connector is provided for hollow profiled elements of spacer frames or bars for insulated glass panes. The straight connector comprises a plurality of connector legs originating from a connection point in different directions with retaining elements for meshing with the hollow profiled element and a base plate and comprises a raised support base. On both sides of the raised support base, the fin-like retaining elements are arranged in a row one after another at the connector legs on the top side of the base plate. The support base is arranged centrally in the longitudinal direction of the straight connector and has a center stop for the hollow profiled elements that can be plugged in on both sides at the connection point.

The plug connector according to the invention, preferably in the form of a straight connector, is especially well suited for warm-edge hollow profiled elements, which reduce the heat transfer between the glass panes of an insulated glass pane adjoining same, and have a mechanically delicate hollow profiled element wall. They may be designed as very thin-walled stainless steel profiles and/or as relatively soft plastic profiles.

The plug connector according to the invention has the advantage that it offers very good retention as well as optimal tolerance absorption, on the one hand, in the plugged-in position in the hollow profiled element and, on the other hand, the best possible mechanical protection of the hollow profiled element. In addition, the plug connector ensures especially good stabilization of the hollow profiled elements plugged onto the connector legs bilaterally at the connection point. The transmission and supporting of forces acting externally on the spacer frame is optimized. Further, undesired deformations of the hollow profiled elements that may occur can be eliminated.

The preferably fin-like and elastic retaining elements, of which a plurality is present, ensure secure retention in the plugged-in hollow profiled element and can, besides, sealingly fill the interior space of the profile together with the base plate. The retaining elements can act especially gently and especially at an axially spaced location from the front end of the hollow profiled element.

The especially mechanically delicate front edges of the hollow profiled elements may be supported by a support base of the plug connector, which may, besides, assume an aligning function for possibly deformed profile front sides. The support base can likewise absorb possible tolerances of the profile, for which an elastic design, especially with one or more cavities located on the inside, is advantageous. Upright longitudinal and transverse walls inside and at the edge of the cavity or cavities, which said walls support the roof wall, are advantageous for the stability of the support base and the straight connector, and the capacity to absorb tolerances of the profile is preserved. The individual central support base securely supports the hollow profiled elements plugged onto it bilaterally, and it also stabilizes, besides, the plug connector and the plug connector at the connection point.

The support base may carry, besides, a center stop. This may comprise fixed stops diagonally offset in relation to one another and be advantageously arranged on the roof wall of the support base, so that a stop is formed here securely and, in addition, there is a possible aligning function for the hollow profiled elements. The support base may ensure, besides, sealing of the junction and connection point of the hollow profiled elements. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4 is a bottom view of the plug connector from FIG. 1;

FIG. 5 is a side view of the plug connector from FIG. 1;

FIG. 6 is a top view of the plug connector from FIG. 1; and

DESCRIPTION OF THE PREFERRED EMBODIMENTS

The present invention pertains to a plug connector (1) for hollow profiled elements (2) of spacer frames or of bars for insulated glass panes. The present invention pertains, further, to a plug connection comprising a hollow profiled element (2) and plugged-in plug connector (1).

The plug connector (1) is preferably designed as a straight connector. As an alternative, it may be shaped as a corner angle. FIGS. 1 through 8 show a straight connector (1) in various variants.

The plug connector (1) preferably consists of plastic and is designed, e.g., as an injection-molded part. As an alternative, it may consist of other materials, especially metal or composite materials. It may also be manufactured by casting or by other shaping methods. The plug connector (1) is preferably of a one-part design.

Figure 2:
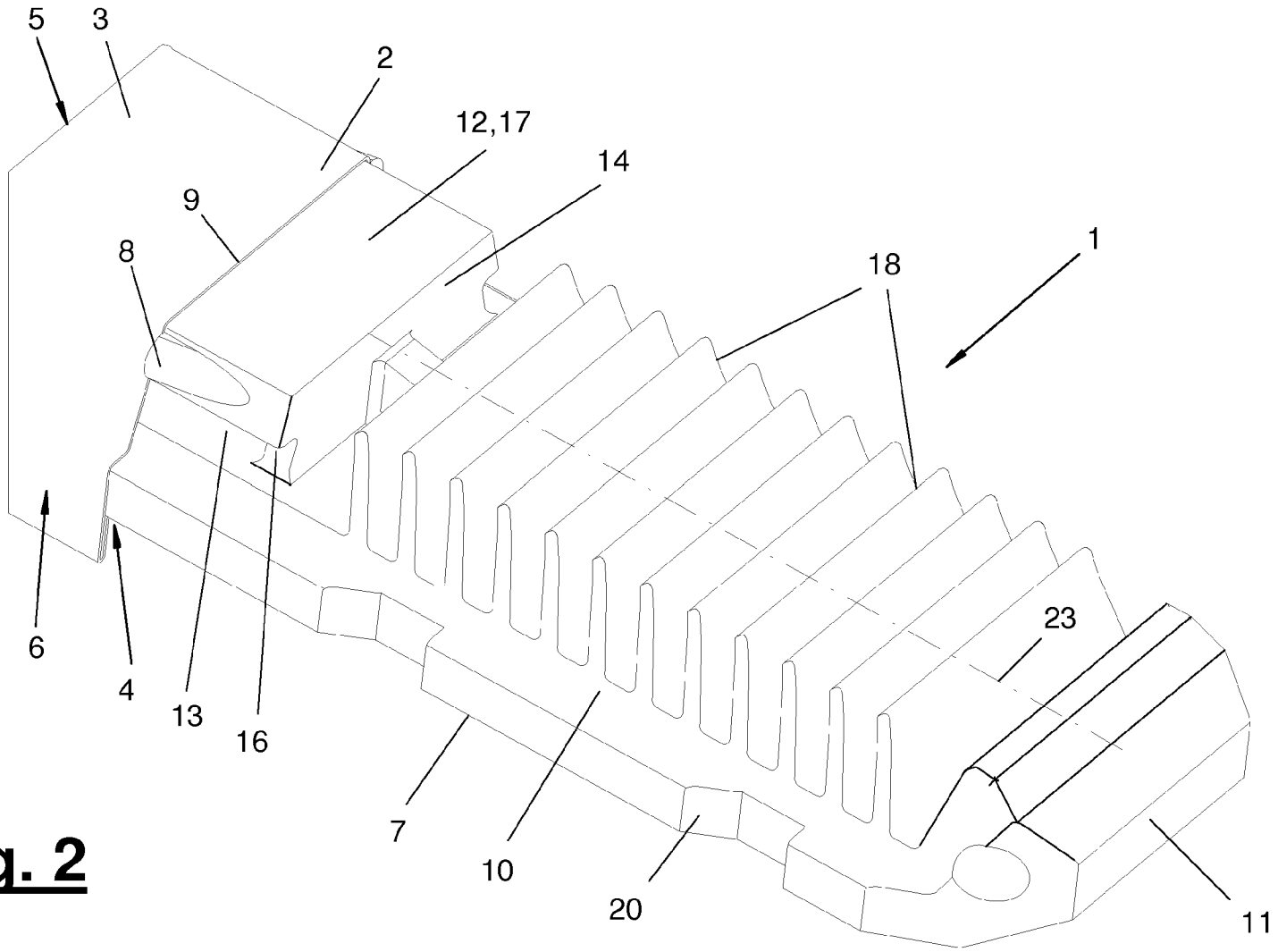
FIG. 2 is a cut-away detail view of the plug connector from FIG. 1.

FIG. 2 shows a cut-away view of a hollow profiled element (2). It is designed, e.g., as a heat-insulating warm-edge profile consisting of plastic and/or metal, especially as a thin-walled stainless steel profile. It may also consist of a composite material.

The hollow profiled elements (2) have a profile roof (3), a profile bottom (4) and side walls, which enclose an inner cavity (5). The profile roof (3) may have an arched shape and is directed towards the outer side of the frame or toward the outer side of an insulated glass pane in the installed position and is optionally coated with a sealant. The profile bottom (4) points towards the inner side of the frame or pane and may have an essentially flat shape. The side walls may optionally project somewhat downwardly over the profile bottom (4). The hollow profiled elements (2) may have an essentially prismatic cross section, and the side walls may have the stepped and partially oblique shape shown in FIG. 2. The hollow profiled elements (2) are plugged bilaterally onto the plug connector (1) and abut tightly against one another with their front sides at a connection point or junction point (9).

Figure 8:
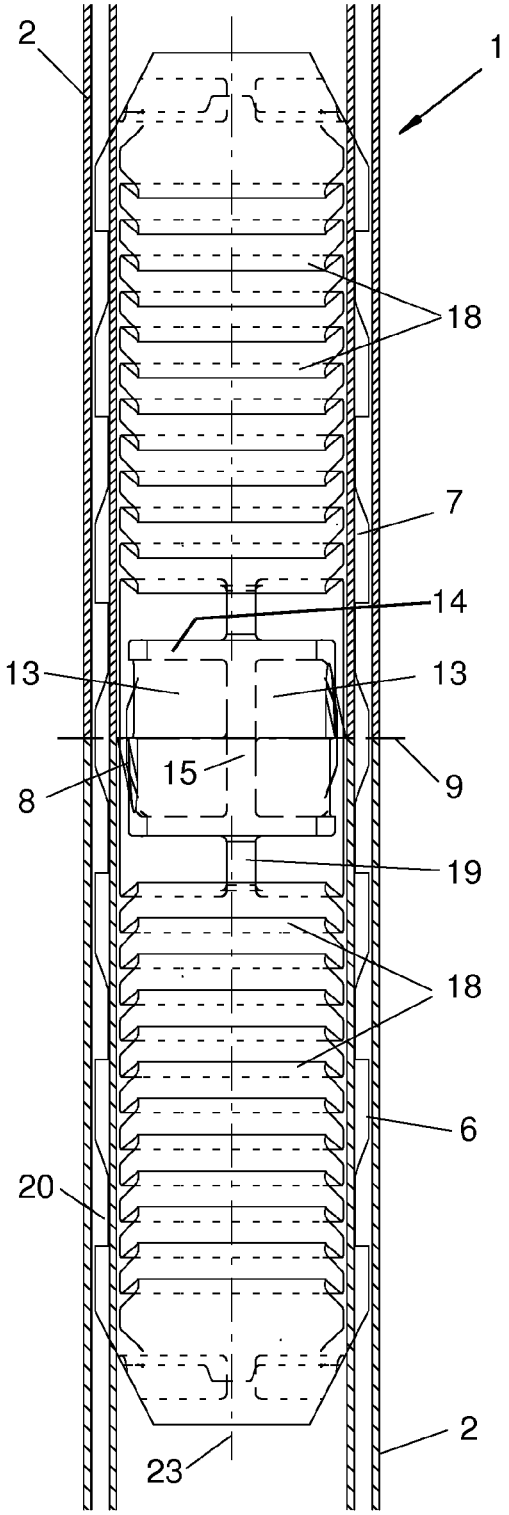
FIG. 8 is a view showing one of two variants of the straight connector from FIGS. 1 through 6.

The connection point (9) is preferably arranged centrally in the longitudinal direction (23) of the straight connector (1). FIG. 8 shows in the top view a straight connector (1) with two plugged-in hollow profiled elements (2) with front-side abutting contact at the connection point (9) and with cut-away side wall areas.

A granulated desiccant, which is in connection with the interior space of the pane via a hole in the profile bottom (4), may be arranged in the cavity (5). The individual panes of the insulated glass pane, which are not shown in the drawings, are flatly in contact with the preferably flat side walls of the hollow profiled element (2) and are optionally bonded here.

The plug connector (1) has a plurality of, especially two connector legs (6, 7), which originate from the central connection point (9) in different, especially opposite directions, and onto which the hollow profiled elements (2) are plugged. The plug connector (1) has a base plate (10), on the top side of which a raised support base (12) is arranged at the connection point (9). Fin-like retaining elements (18) are arranged on the same top side of the base plate or bottom plate (10) bilaterally from the support base (12). At the ends, the bottom plate (10) carries a thickened boss (11) provided with oblique sliding surfaces.

The retaining elements (18) are located each at a connector leg (6, 7) and are arranged there in a preferably single row one after another and at axially spaced locations along the longitudinal axis (23) of the plug connector (1). They are located each between the support base (12) and the end-side boss (11) at the connector legs (6, 7). They are located each at somewhat spaced locations axially from the support base (12) and the connection point (9), which is a central connection point there.

The retaining elements (18) are arranged in the central area of the top side of the base plate and are directed at right angles to the longitudinal axis (23). They extend over the entire width or at least a major part of the width of the base plate (10).

The retaining elements (18) comprise a plurality of thin-walled and plate-shaped fins, which are located at spaced locations from one another, project upward and may have an oblique orientation. They are each sloped at the connector legs (6, 7) towards the central connection point (9). The retaining elements (18) or fins having an elastic design may have a bevel on the top side. They become deformed and dig into the inner walls of the hollow profiled element (2), especially in the profile roof (3) when they are plugged in. In the undeformed state, they project for this, at least in some areas, beyond the outer contour of the support base (12) and optionally beyond the bosses (11). In particular, the undeformed retaining elements (18) or fins may project with their free ends vertically above the support base (12) and the roof wall (17) thereof.

Due to their elasticity, the retaining elements (18) bring about a horizontal and vertical absorption of any possible tolerances of the profile. Further, together with the base plate (10), they fill the cross section of the cavity and exert a sealing action.

The plug connector (1) shown has a cross-sectional shape that is adapted to the inner contour of the hollow profiled element (2). In the longitudinal direction (23), it has a closed shape, which is impermeable to a granulated desiccant in the hollow profiled elements (2) and prevents the desiccant from reaching the connection point (9). The base plate (10) with the fin-like retaining elements (18), the bosses (11) and the support bases (12) has a corresponding shape filling out the profile cavity (5) for this. The fin-like retaining elements (18) are adapted especially to the shape of the profile roof (3) and seal the cavity (5).

A larger number of retaining elements (18) in a row is favorable for distributing the forces and the working points on the hollow profiled element wall subject to the action. As a result, the sum of the retention forces will be high and the load on the hollow profiled element (2) will be uniform and cause little deformation. In addition, the sealing action is optimized while a kind of labyrinth seal is formed. Two retaining elements (18) each are arranged in one row in the variants being shown. The number may vary upward and downward. Arrangement of five or more retaining elements (18) each in a row at the legs (6, 7) is advantageous.

The retaining elements (18) have, e.g., all the same shape and size. In a variant of the embodiment being shown, one or more of the upper retaining elements or fins (18) may have an increased width on both sides and a possibly reduced foot at the transition point into the top side of the leg wall (12). As a result, they have a larger area and are more flexible than the other fins (18), and when plugged into a hollow profiled element (2), they can deform differently and more strongly and achieve as a result an even better filling of the cavity (5) and an even better sealing action. Such a fin shape is suitable for hollow profiled elements (2) that have a greater deformation resistance of the profile wall. The design shown is recommended in case of more labile hollow profiled element walls.

With its upper and lateral outer contour, the central support base (12) has a shape adapted to the profile roof (3) and the side walls of the hollow profiled elements (2) and supports this part of the hollow profiled element wall at the connection point (9). The hollow profiled elements are plugged on both sides onto the individual central support base (12). The support base (12) may extend over the entire width of the base plate (10) or at least over the major part of the width of the base plate (10). In the exemplary embodiments shown, the base plate (10) has edges, which project laterally over the support base (12) and the fin-like retaining elements (18) on both sides and which mesh with lateral bulges of the side walls of the profile. This shape is adapted to the cross-sectional shape of the hollow profiled elements (10) and may change accordingly.

The support base (12) is designed as a hollow body. It may have a roof wall (17) and a one-part or multipart cavity (3) located under it. The roof wall is directed essentially in parallel to the flat base plate (10), and the cavity (13) is located between the two walls (10, 17). The cavity is preferably open towards one or both side edges of the plug connector.

The support base (12) may also have an elastic design, in which case the roof wall (17) may have a spring action due to a corresponding shape. For example, it may have for this an oversize in height relative to the inner height of the hollow profiled element (2). As a result, it absorbs possible tolerances of the hollow profiled element and can again, if needed, align a possibly deformed profile roof (3) and bring it to the desired shape.

Figure 7:
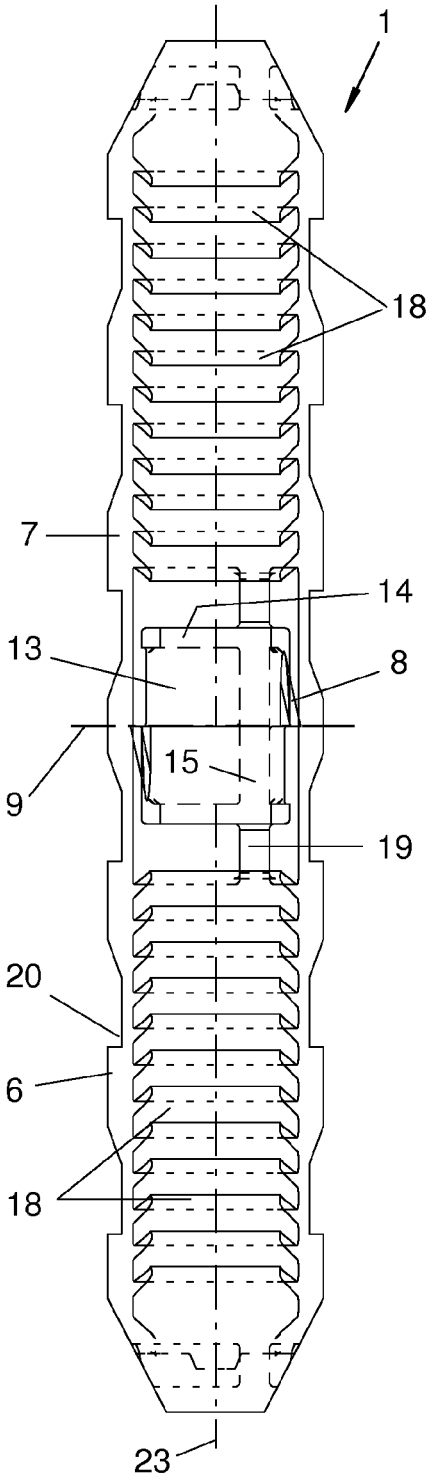
FIG. 7 is a view showing one of two variants of the straight connector from FIGS. 1 through 6.

As is indicated in the top views in FIGS. 6, 7 and 8 by hidden broken lines, the support base (12) has one or more, preferably two upright transverse walls (14), which are arranged between the roof wall (17) and the base plate (10). The transverse walls (14) are directed each at right angles to the longitudinal direction (23) and are located at spaced locations from one another in said longitudinal direction (23), and they define the cavity (13) between themselves. The transverse walls (14) are arranged at the front and rear edges of the support base (12) in the embodiment being shown.

Figure 1:
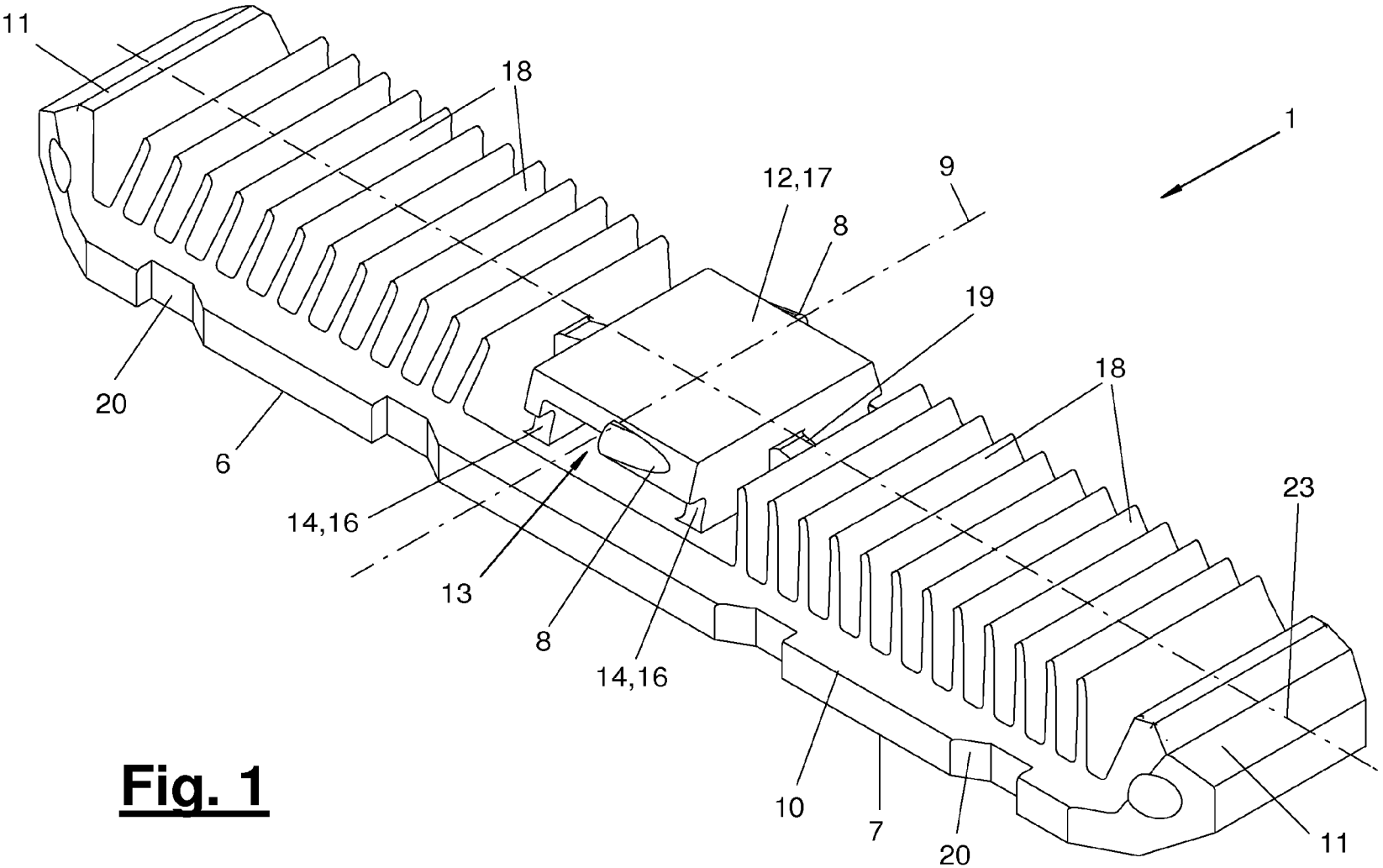
FIG. 1 is a perspective view of a plug connector.

As is illustrated in FIGS. 1, 2 and 5, the roof wall (17) projects, at least on one side, laterally beyond the transverse walls (14). The transverse walls (14) may have for this a bilaterally shortened length or a bilateral reduction with lateral cut-outs (16). This unilateral or bilateral projection of the roof wall (17) can possibly yield elastically downwardly when the hollow profiled elements (2) are plugged on. It may be used to compensate pressure for one or both hollow profiled elements (2).

According to FIG. 6, the support base (12) has, in the exemplary embodiments being shown, a multipart cavity (13), which is formed by two pocket-like recesses that are open laterally towards a longitudinal side of the connector. A symmetrical design may be present, in which case a central, upright, partitioning longitudinal wall (15), which extends between the roof wall (17) and the base plate (10) and preferably extends up to the transverse walls (14), may be present in this case. The roof wall (17) is supported in the middle area at the longitudinal wall (15) and at the transverse walls (14) on the front side. There preferably is a connection in substance between the walls (10, 14, 15, 17).

FIGS. 7 and 8 show variants of the plug connector (1), in which the longitudinal wall (15) is arranged in the support base (12) eccentrically when viewed in the direction of the width. The cavities or pocket-like recesses have different depths.

The plug connector (1) has a center stop (8) for the hollow profiled elements (2) to be plugged on bilaterally, which center stop may have various designs and be arranged in different ways. In the embodiments being shown, the center stop (8) is arranged at the support base (12). It is preferably located now at the lateral edges of the roof wall (17) and projects beyond this laterally. The center stop (8) is formed in the exemplary embodiments by two fixed stops, which are aligned and arranged on both sides of the central connection point (9) and are diagonally offset in relation to one another. These have a wedge shape, which rises towards the connection point (9) and drops there steeply while forming a stop face. Such a fixed stop is arranged now at each roof edge.

The center stop (8) is intended and designed for a tight mutual front-side abutting contact of the hollow profiled elements (2) at the connection point (9). It is located at the axial center of the support base (12). FIGS. 1 and 2 illustrate this design and arrangement.

The above-mentioned offset fixed stops are located with their respective stop faces in the immediate vicinity of the connection point (9). The hollow profiled element (2) plugged in) first slides over the fixed stop located on this side of the connection point (9) along the rising wedge flank of that fixed stop while it possibly undergoes deformation and is aligned. It then comes into contact with the fixed stop located beyond the connection point (9). After passing over its fixed stop located closer to it, the second hollow profiled element (2) comes into contact with the front side of the first hollow profiled element (2).

The sealing stop function of the center stop (8) can also be achieved with another stop construction. Further, it is possible to connect the abutted profile ends in substance and permanently, e.g., by welding.

An axial rib (19) each, which extends between the transverse wall (14) and the first fin-like retaining element (18) located at an axially spaced location, is arranged preferably centrally on the base plate (10) at each leg (6, 7). The axial rib (19) may end here or may, as an alternative, extend even farther in the direction of the boss (11) through the row of the retaining elements (18) following it. The rib (19) may have a reinforcing effect.

The rib (19) may be flush, according to FIGS. 6, 7 and 8, with the inner longitudinal wall (15) of the support base (12) in the direction of the longitudinal axis (23). This has advantages for the mechanical stability of the plug connector (1) and the plug connection. FIG. 6 shows the above-mentioned central arrangement of the rib (19) and the longitudinal wall (15). FIGS. 7 and 8 show non-central, axially flush arrangements. The straight connectors (1)

according to FIGS. 7 and 8 may otherwise correspond to the exemplary embodiment according to FIGS. 1 through 6.

As is shown in the top view in FIG. 6, the base plate (10) may have one or more set-back recesses (20) each at the lateral edges of both legs (6, 7). They may form free spaces for peeling, which may possibly occur because of tolerances of the hollow profiled element.

The base plate (10) is arranged at the bottom in the plugged-in position and is in contact with the profile bottom (4), and it likewise points towards the inner side of the frame and pane.

Figure 3:
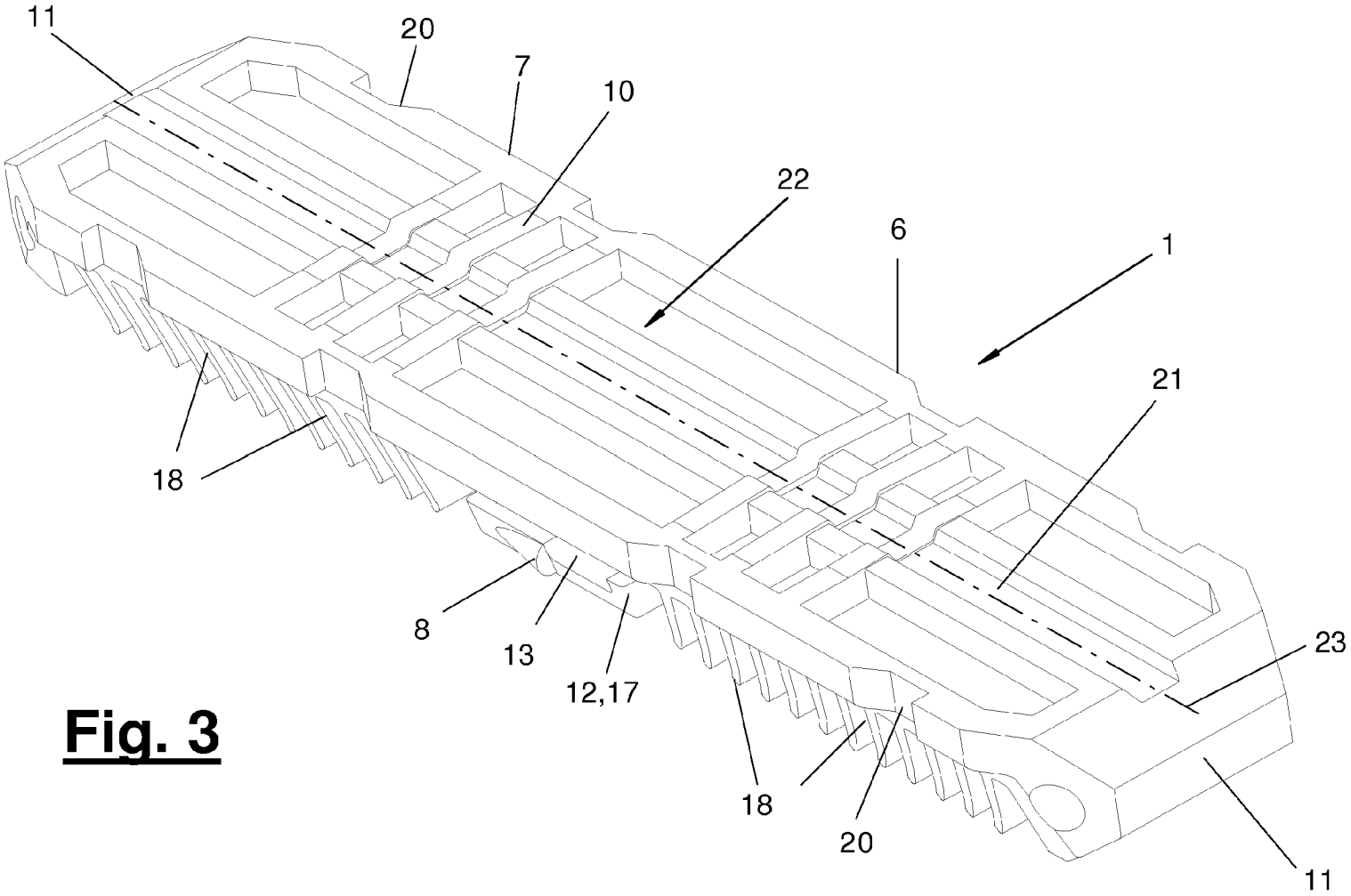
FIG. 3 is a perspective view of the underside of the plug connector from FIGS. 1 and 2.

As is shown in FIGS. 3 and 4, the base plate (10) may have a central axial channel (21) on the underside. This may optionally receive a weld seam or a row of perforations or the like at the profile bottom (4) and extend over same in the plugged-in position. The base plate (10) has, further, a rib structure (22) with longitudinal and transverse ribs as well as a plurality of depressions on the underside. This shape increases the bending resistance of the plug connector (1).

Various variants of the embodiments shown and described are possible. The cross-sectional shape of the hollow profiled elements (2) and correspondingly also of the plug connector (1) may change. The number and alignment of the retaining elements (18) may vary. A center stop (8) may be arranged at another location of the plug connector (1), e.g., on the base plate (10). The center stop (8) may also have a different structural design and may comprise, e.g., two or four elastic retaining bosses or two combinations of a spring boss and a fixed stop located opposite on the other side of the connection point (9). The plug connector (1) may have, in addition to the above-mentioned retaining elements (18), further elastic retaining elements, e.g., in the form of fins, on one or both lateral edges. The number, arrangement and design of the cavity (13) and of the walls (14, 15) are variable as well. For example, a longitudinal wall (15) or transverse walls (14) may be eliminated or a crossed arrangement of an individual longitudinal wall and transverse wall (15, 14) may be provided. Furthermore, the features of the above-described exemplary embodiments and variants thereof may be combined with one another in any desired manner. This includes transposition of features or even a partial omission of features.

While specific embodiments of the invention have been shown and described in detail to illustrate the application of the principles of the invention, it will be understood that the invention may be embodied otherwise without departing from such principles.

The invention claimed is:

1. A straight plug connector for hollow profiled elements of spacer frames or bars for insulated glass panes, the straight connector comprising:

a plurality of connector legs originating from a connection point in different directions;

fin-shaped retaining elements for meshing with the hollow profiled element;

a base plate;

a raised support base, wherein the fin-shaped retaining elements are arranged on both sides of the support base with respect to a longitudinal direction of the straight connector in a row one after another at the connector legs on a top side of the base plate and the support base is arranged centrally, with respect to the longitudinal direction of the straight connector and has a center stop for the hollow profiled elements that can be plugged in on both sides at the connection point, the support base having a roof wall and a cavity located under the roof wall, the support base having transverse walls between the roof wall and the base plate, the transverse walls being located at spaced locations in the longitudinal direction and the transverse wall defining a portion of the cavity;

an axial rib arranged on the base plate between one of the transverse walls and an adjoining fin-shaped retaining element or retaining elements.

2. A straight connector in accordance with claim 1, wherein the base plate comprises base plate edges, the base plate edges projecting laterally over the support base and the fin-shaped retaining elements on both sides of the fin-shaped retaining elements in a direction transverse to the longitudinal direction.

3. A straight connector in accordance with claim 2, wherein the fin-shaped retaining elements have a plate design and are aligned at right angles to a longitudinal axis of the straight connector and have a shape corresponding to an upper hollow profiled element contour, the transverse walls extending perpendicular to the longitudinal axis, the center stop being in direct contact with the support base, the center stop comprising a hollow profile contact surface for contacting a hollow profiled element.

4. A straight connector in accordance with claim 2, wherein the fin-shaped retaining elements are arranged at the connector legs obliquely and sloped towards the connection point.

5. A straight connector in accordance with claim 2, wherein the fin-shaped retaining elements project vertically at the connector legs beyond an outer contour of the support base, in an undeformed state at least in some areas.

6. A straight connector in accordance with claim 2, further comprising a boss is arranged at each of two ends of the base plate.

7. A straight connector in accordance with claim 2, wherein the support base has a shape adapted to a profile roof and to side walls of the hollow profiled elements on upper and lateral outer contours.

8. A straight connector in accordance with claim 2, wherein the support base is designed as a hollow body, the base plate comprising a first base plate portion and a second base plate portion, the first base plate portion and one of the base plate edges being located on a first lateral side of the fin-shaped retaining elements and the support base with respect to the longitudinal direction, the second base plate portion and another one of the base plate edges being located on a second lateral side of the fin-shaped retaining elements and the support base with respect to the longitudinal direction, the first base plate portion extending from the first lateral side of the fin-shaped retaining elements and the support base to the one of the base plate edges, wherein the one of the base plate edges is located at a spaced location from the fin-shaped retaining elements and the support base, the second base plate portion extending from the second lateral side of the fin-shaped retaining elements and the support base to the another one of the base plate edges, wherein the another one of the base plate edges is located at a spaced location from the fin-shaped retaining elements and the support base.

9. A straight connector in accordance with claim 2, wherein the support base is elastic.

10. A straight connector in accordance with claim 2, wherein the roof wall is elastic and is configured to have an oversize relative to the hollow profiled element.

11. A straight connector in accordance with claim 2, wherein the roof wall projects laterally over the transverse walls at least on one side.

12. A straight connector in accordance with claim 2, wherein the support base has two or more cavities open laterally towards a longitudinal side of the connector and a central or laterally offset longitudinal wall, which extends, from the base plate to a roof wall, in between.

13. A straight connector in accordance with claim 2, wherein the longitudinal wall and the axial rib are arranged such that they are axially flush.

14. A straight connector in accordance with claim 2, wherein the center stop is designed for a front-side abutting contact of the hollow profiled elements at the connection point.

15. A straight connector in accordance with claim 2, wherein the base plate has recesses at lateral edges thereof.

16. A straight connector in accordance with claim 2, wherein the base plate has a central, axial channel on an underside.

17. A straight connector in accordance with claim 2, wherein the base plate has a rib structure on an underside.

18. A straight connector in accordance with claim 2, wherein the straight connector has a cross-sectional shape adapted to the inner contour of the hollow profiled element.

19. A straight connector in accordance with claim 2, wherein the straight connector has a closed cross-sectional shape in the longitudinal direction, which shape is impermeable for a granulated desiccant in a hollow profiled element.

20. A straight connector in accordance with claim 2, wherein the straight connector consists of plastic, metal or a composite material.

21. A straight connector in accordance with claim 2, wherein the fin-shaped retaining elements extend over an entire width or over a majority part of the width of the base plate.

22. A straight connector in accordance with claim 1, wherein the center stop is arranged on the roof wall, at lateral roof wall edges, of the support base.

23. A plug connection comprising a hollow profiled element of a spacer frame or of a bar for an insulated glass pane; and an inserted straight connector, wherein the straight connector comprising:

a plurality of connector legs originating from a connection point in different directions;

fin-shaped retaining elements for meshing with the hollow profiled element;

a base plate;

a raised support base, wherein the fin-shaped retaining elements are arranged on both sides of the support base with respect to a longitudinal direction of the straight connector in a row one after another at the connector legs on a top side of the base plate and the support base is arranged centrally, with respect to the longitudinal direction of the straight connector and has a center stop for the hollow profiled elements that can be plugged in on both sides at the connection point, the support base having a roof wall and a cavity located under the roof wall, the support base having transverse walls between the roof wall and the base plate, the transverse walls being located at spaced locations in the longitudinal direction and the transverse wall defining a portion of the cavity;

an axial rib arranged on the base plate between the transverse wall and the adjoining fin-shaped retaining element or retaining elements.

24. A plug connection in accordance with claim 23, wherein the base plate comprises base plate edges, the base plate edges projecting laterally over the support base and the fin-shaped retaining elements on both sides of the fin-shaped retaining elements.

25. A plug connection in accordance with claim 24, wherein the hollow profiled element is designed as a heat-insulating and warm-edge profile made of plastic and/or metal stainless steel, the transverse walls being perpendicular to the longitudinal direction, the center stop being in direct contact with the support base, the center stop comprising a hollow profile contact surface for contacting the hollow profiled element, the base plate comprising a first base plate portion and a second base plate portion, the first base plate portion and one of the base plate edges being located on a first lateral side of the fin-shaped retaining elements and the support base with respect to the longitudinal direction, the second base plate portion and another one of the base plate edges being located on a second lateral side of the fin-shaped retaining elements and the support base with respect to the longitudinal direction, the first base plate portion extending from the first lateral side of the fin-shaped retaining elements and the support base to the one of the base plate edges, wherein the one of the base plate edges is located at a spaced location from the fin-shaped retaining elements and the support base, the second base plate portion extending from the second lateral side of the fin-shaped retaining elements and the support base to another one of the base plate edges, wherein the another one of the base plate edges is located at a spaced location from the fin-shaped retaining elements and the support base.

26. A straight plug connector for hollow profiled elements of spacer frames or bars for insulated glass panes, the straight connector comprising:

a plurality of connector legs originating from a connection point in different directions;

fin-shaped retaining elements for meshing with the hollow profiled element;

a base plate;

a raised support base, wherein the fin-shaped retaining elements are arranged on a first support base side and a second support base side of the support base in a row one after another at the connector legs on a top side of the base plate and the support base is arranged centrally, with respect to a longitudinal direction of the base plate and the raised support base has a center stop for contacting one of the hollow profiled elements that can be plugged in on one of the first support base side and the second support base side at the connection point, the first support base side being opposite the second support base side with respect to the longitudinal direction, the support base having a roof wall, a first transverse wall and a second transverse wall, the first transverse wall and the second transverse wall being arranged between the roof wall and the base plate, the first transverse wall and the second transverse wall extending in a direction transverse to the longitudinal direction of the base plate, the first transverse wall being located at spaced location from the second transverse wall in the longitudinal direction, the first transverse wall, the second transverse wall, the base plate and the roof wall defining a cavity;

an axial rib arranged on the base plate between the transverse wall and at least one adjoining fin-shaped retaining element.

* * * * *